US007586395B2

(12) United States Patent
Weister et al.

(10) Patent No.: US 7,586,395 B2
(45) Date of Patent: Sep. 8, 2009

(54) ELECTRICAL SWITCHING APPARATUS AND TRIP ACTUATOR ASSEMBLY THEREFOR

(75) Inventors: Nathan J. Weister, Darlington, PA (US); Lance Gula, Clinton, PA (US)

(73) Assignee: Eaton Corporation, Cleveland, OH (US)

( * ) Notice: Subject to any disclaimer, the term of this patent is extended or adjusted under 35 U.S.C. 154(b) by 190 days.

(21) Appl. No.: 11/696,810

(22) Filed: Apr. 5, 2007

(65) Prior Publication Data

US 2008/0245648 A1 Oct. 9, 2008

(51) Int. Cl.
*H01H 9/00* (2006.01)

(52) U.S. Cl. ..... 335/172; 335/6; 335/9; 335/21; 335/77; 335/78; 335/164; 361/42; 361/43; 361/44; 361/45; 361/46; 361/47

(58) Field of Classification Search ..... 335/6, 335/9, 21, 77, 78, 164, 172; 361/42–47
See application file for complete search history.

(56) References Cited

U.S. PATENT DOCUMENTS 1,399,495 A * 12/1921 Krantz ..... 200/50.08
1,931,507 A * 10/1933 Reed ..... 335/21
3,826,951 A * 7/1974 Mater et al. ..... 361/100
5,836,441 A * 11/1998 Scheel et al. ..... 200/17 R
6,072,136 A * 6/2000 Wehrli et al. ..... 200/401
6,433,555 B1 * 8/2002 Leopold et al. ..... 324/509
6,921,873 B2 7/2005 Puskar et al.
7,358,836 B2 * 4/2008 Carlino et al. ..... 335/6
2004/0070474 A1 * 4/2004 Wu et al. ..... 335/18
2005/0023120 A1 * 2/2005 Puskar et al. ..... 200/321
2006/0244557 A1 * 11/2006 Sorenson ..... 335/172
2007/0268097 A1 * 11/2007 Elviro et al. ..... 335/6

* cited by examiner

*Primary Examiner*—Elvin G Enad
*Assistant Examiner*—Mohamad A Musleh
(74) *Attorney, Agent, or Firm*—Martin J. Moran

(57) ABSTRACT

A trip actuator assembly is provided for a circuit breaker including a housing having a mounting surface, separable contacts enclosed by the housing, and an operating mechanism structured to open and close the separable contacts. The trip actuator assembly includes a trip actuator cooperable with the operating mechanism, and a planar member having first and second ends, first and second edges, and an aperture. The trip actuator is at least partially disposed within the aperture and is further disposed between the planar member and the mounting surface of the housing. The first edge of the planar member is removably coupled to the mounting surface, thereby removably coupling the trip actuator to the housing. The circuit breaker may include an accessory tray which is insertable on and is removable from the mounting surface. When inserted, the accessory tray abuts the body of the trip actuator enclosure further securing the trip actuator.

19 Claims, 6 Drawing Sheets

ELECTRICAL SWITCHING APPARATUS AND TRIP ACTUATOR ASSEMBLY THEREFOR

CROSS-REFERENCE TO RELATED APPLICATIONS

This application is related to commonly assigned, concurrently filed:

U.S. patent application Ser. No. 11/696,815, filed Apr. 5, 2007, entitled "ELECTRICAL SWITCHING APPARATUS, AND TRIP ACTUATOR ASSEMBLY AND RESET ASSEMBLY THEREFOR"; and U.S. patent application Ser. No. 11/696,812, filed Apr. 5, 2007, entitled "ELECTRICAL SWITCHING APPARATUS AND TRIP ACTUATOR RESET ASSEMBLY THEREFOR", which are hereby incorporated herein by reference.

BACKGROUND OF THE INVENTION

1. Field of the Invention

The invention relates generally to electrical switching apparatus and, more particularly, to trip actuator assemblies for electrical switching apparatus, such as circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip unit.

Among other components, the operating mechanisms of some low-voltage circuit breakers, for example, typically include a pole shaft and a trip actuator assembly. The pole shaft pivots during opening and closing operations of the circuit breaker, which operations respectively correspond to electrical contact assemblies being opened (e.g., contacts separated) and closed (e.g., contacts electrically connected). The trip actuator assembly typically includes a trip bar, a trip actuator such as, for example, a solenoid, and a cradle assembly. The cradle assembly is coupled to and is cooperable with the pole shaft. The trip actuator (e.g., solenoid) has a spring, a coil which is energized by the trip unit in response to the electrical fault condition, and an actuating element such as, for example, a plunger. Normally (e.g., in the absence of the electrical fault condition), the plunger is latched (e.g., by a magnet) in a retracted position. When the coil is energized, in response to the electrical fault condition, the magnetic force that holds the plunger in the retracted position is overcome and the spring biases the plunger to an extended position and maintains it there. When the plunger extends, it causes the trip bar to pivot and trip open the electrical contact assemblies.

Subsequently, both the electrical contact assemblies and the trip actuator must be reset. The trip actuator assembly operates in conjunction with the pole shaft to perform the resetting operation. Specifically, when the circuit breaker operating mechanism is reset, the pole shaft pivots, thereby moving the cradle assembly. The cradle assembly then pivots a reset arm which, in turn, depresses the actuating element (e.g., plunger) and resets the trip actuator (e.g., solenoid). However, the travel and actuating force of the plunger are relatively limited. Therefore, to ensure that the trip actuator assembly consistently performs properly, the trip actuator assembly must be well designed, and the trip actuator of this assembly must be accurately installed and maintained in a precise predetermined position within the circuit breaker.

In the above regard, known trip actuator assemblies suffer from a number of disadvantages. Among them is the fact that at least one component of the trip actuator assembly and, in particular, the trip actuator, is typically fastened to a portion of the circuit breaker that has no correlation to the tripping and/or resetting function(s) of the circuit breaker. This, alone or in combination with the fact that the trip actuator is typically fastened to such portion using hardware (e.g., brackets) and a plurality of fasteners, can result in misalignment of the trip actuator. In other words, misalignment of the trip actuator can result not only from the positioning of the hardware and trip actuator during its installation, but also from the fact that each component of the circuit breaker tends to vary in precise dimension due, for example, to manufacturing tolerances. When the circuit breaker is assembled, the tolerance variations from one part of the circuit breaker to the next can undesirably accumulate or "stack" up. Consequently, the accuracy with which the trip actuator is installed can be compromised, adversely affecting circuit breaker performance.

A further disadvantage of known trip actuator assemblies is that they tend to be relatively complex, and include numerous components. They, therefore, require the aforementioned plurality of fasteners, as well as separate tools (e.g., without limitation, screw drivers) to fasten and/or remove such fasteners and the hardware that secures the trip actuator within the circuit breaker.

It is desirable, therefore, to provide a trip actuator assembly in which the trip actuator is maintained in a precise predetermined position with respect to the components (e.g., without limitation, pole shaft; cradle assembly) of the circuit breaker with which the trip actuator cooperates, yet that can relatively quickly and easily be accurately installed or be removed, replaced, and/or maintained.

There is, therefore, room for improvement in electrical switching apparatus, such as circuit breakers, and in trip actuator assemblies therefor.

SUMMARY OF THE INVENTION

These needs and others are met by embodiments of the invention, which are directed to a trip actuator assembly for electrical switching apparatus, such as circuit breakers, which trip actuator assembly accurately, yet removably mounts the trip actuator within the circuit breaker, without requiring a plurality of separate fasteners.

As one aspect of the invention, a trip actuator assembly is provided for an electrical switching apparatus including a housing having a mounting surface, separable contacts enclosed by the housing, and an operating mechanism structured to open and close the separable contacts. The trip actuator assembly comprises: a trip actuator structured to be cooperable with the operating mechanism; and a planar member comprising a first end, a second end disposed opposite and distal from the first end, a first edge, a second edge disposed opposite and distal from the first edge, and an aperture. The trip actuator is structured to be at least partially disposed within the aperture and further to be disposed between the planar member and the mounting surface of the housing. The first edge of the planar member is structured to be removably coupled to the mounting surface of the housing, thereby being structured to removably couple the trip actuator to the housing.

The trip actuator may comprise an enclosure including a first end having an actuating element, and a second end disposed opposite and distal from the first end. When the trip actuator is removably coupled to the mounting surface of the housing, the first end of the enclosure may be engaged by the planar member at the aperture and the second end of the enclosure may be structured to be disposed adjacent the mounting surface of the housing. The first end of the enclosure may further include a recess, and the aperture may comprise a first edge, a second edge, and a top. The top of the aperture may include a protrusion structured to extend into the recess of the first end of the enclosure in order to secure the trip actuator within the aperture, and further to maintain the trip actuator in a desired position with respect to the housing. The trip actuator may be a solenoid, wherein the actuating element of the solenoid may be a plunger.

The mounting surface of the housing of the electrical switching apparatus may comprise a first end including a first slot, and a second end disposed opposite and distal from the first end of the mounting surface of the housing and including a second slot. The first edge of the planar member at or about the first end of the planar member may be structured to removably engage the first slot, and the planar member may be structured to be pivoted until the first edge of the planar member at or about the second end of the planar member removably engages the second slot. The planar member may be structured to removably couple the trip actuator to the housing, without a plurality of separate fasteners.

As another aspect of the invention, an electrical switching apparatus comprises: a housing including a mounting surface; separable contacts enclosed by the housing; an operating mechanism structured to open and close the separable contacts; and a trip actuator assembly comprising: a trip actuator cooperable with the operating mechanism, and a planar member comprising a first end, a second end disposed opposite and distal from the first end, a first edge, a second edge disposed opposite and distal from the first edge, and an aperture. The trip actuator is at least partially disposed within the aperture and further is disposed between the planar member and the mounting surface of the housing. The first edge of the planar member is removably coupled to the mounting surface of the housing, thereby removably coupling the trip actuator to the housing.

The trip actuator assembly may further comprise at least one linking member pivotably coupled to the operating mechanism of the circuit breaker, wherein the trip actuator and the at least one linking member are both coupled to the planar member of the trip actuator assembly. The electrical switching apparatus may be a circuit breaker. The planar member of the trip actuator assembly may be a side plate having a first side, a second side, a first aperture, and a second aperture. The at least one linking member may be a cradle assembly and a reset lever. The reset lever may include a first end and a second end disposed opposite and distal from the first end. The trip actuator may be disposed within the first aperture of the side plate and extend outwardly from the first side of the side plate and the second side of the side plate, and the cradle assembly may be disposed on the second side of the side plate. The reset lever may be pivotably coupled to the first side of the side plate, and the first end of the reset lever may be cooperable with the trip actuator on the first side of the side plate. The second end of the reset lever may extend through the second aperture of the side plate and cooperate with a portion of the cradle assembly on the second side of the side plate.

The housing of the circuit breaker may further include an accessory tray. The body of the enclosure may be a cylinder, and the accessory tray may include a first edge having an arcuate recess and a second edge disposed opposite and distal from the first edge of the accessory tray. When the accessory tray is inserted, the arcuate recess of the accessory tray may engage and secure a portion of the cylinder.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
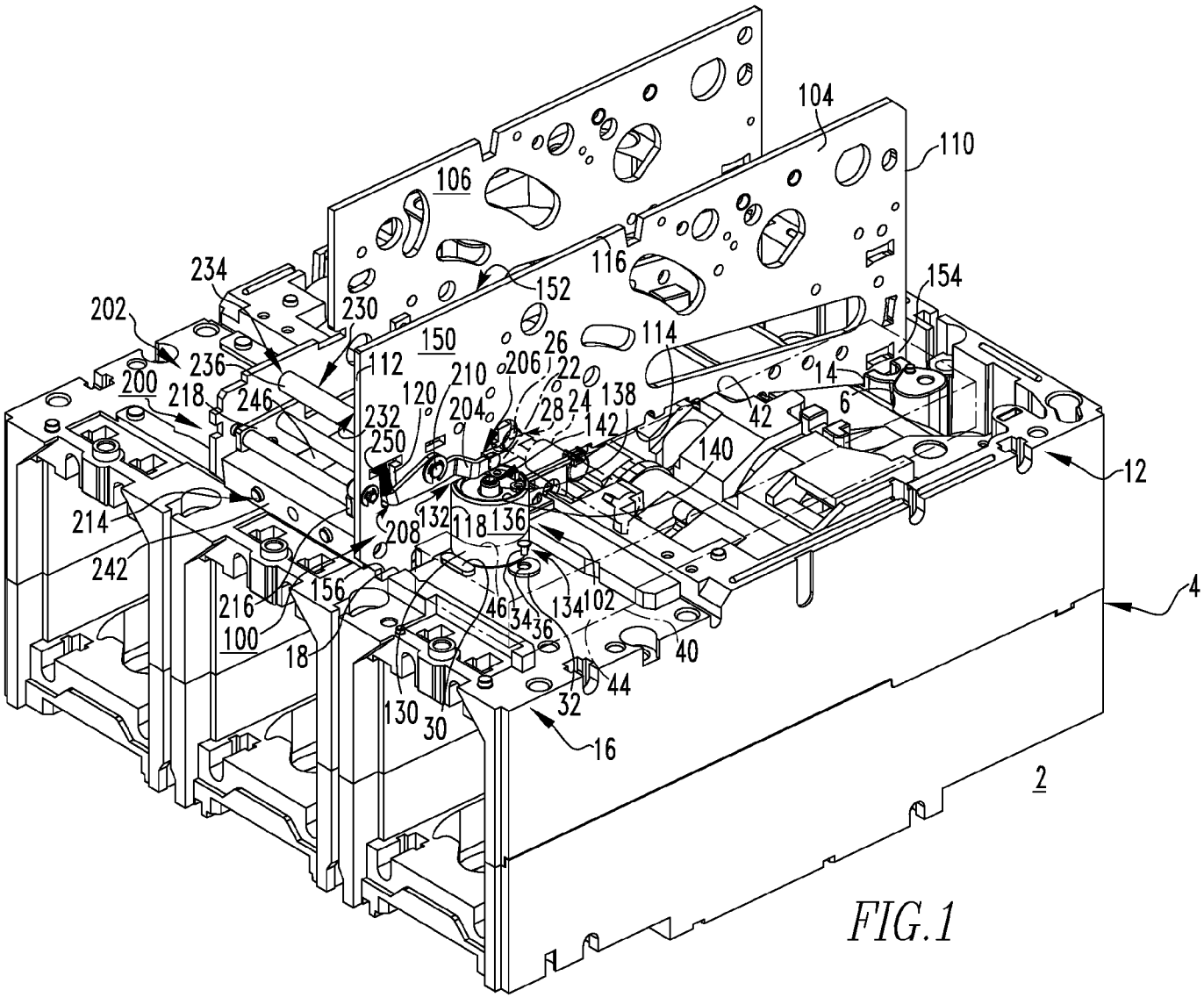
FIG. 1 is an isometric view of a circuit breaker and trip actuator assembly therefor, in accordance with an embodiment of the invention, also showing an accessory tray for the circuit breaker in simplified form in phantom line drawing.

For purposes of illustration, embodiments of the invention will be described as applied to low-voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage circuit breakers and other than low-voltage electrical switching apparatus.

Directional phrases used herein, such as, for example, left, right, top, bottom, upper, lower, front, back, clockwise and counterclockwise and derivatives thereof, relate to the orientation of the elements shown in the drawings and are not limiting upon the claims unless expressly recited therein.

As employed herein, the terms "actuator" and "actuating element" refer to any known or suitable output mechanism (e.g., without limitation, trip actuator; solenoid) for an electrical switching apparatus (e.g., without limitation, circuit switching devices, circuit breakers and other circuit interrupters, such as contactors, motor starters, motor controllers and other load controllers) and/or the element (e.g., without limitation, stem; plunger; lever; paddle; arm) of such mechanism which moves in order to manipulate another component of the electrical switching apparatus.

As employed herein, the term "fastener" shall mean a separate element or elements which is/are employed to connect or tighten two or more components together, and expressly includes, without limitation, rivets, pins, screws, bolts and the combinations of bolts and nuts (e.g., without limitation, lock nuts) and bolts, washers and nuts.

As employed herein, the term "aperture" refers to any known or suitable passageway into or through a component and expressly includes, but is not limited to, openings, holes, gaps, slots, slits, recesses, and cut-outs.

As employed herein, the term "trip condition" refers to any electrical event that results in the initiation of a circuit breaker operation in which the separable contacts of the circuit breaker are tripped open, and expressly includes, but is not limited to, electrical fault conditions such as, for example, current overloads, short circuits, abnormal voltage and other fault conditions, receipt of an input trip signal, and a trip coil being energized.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
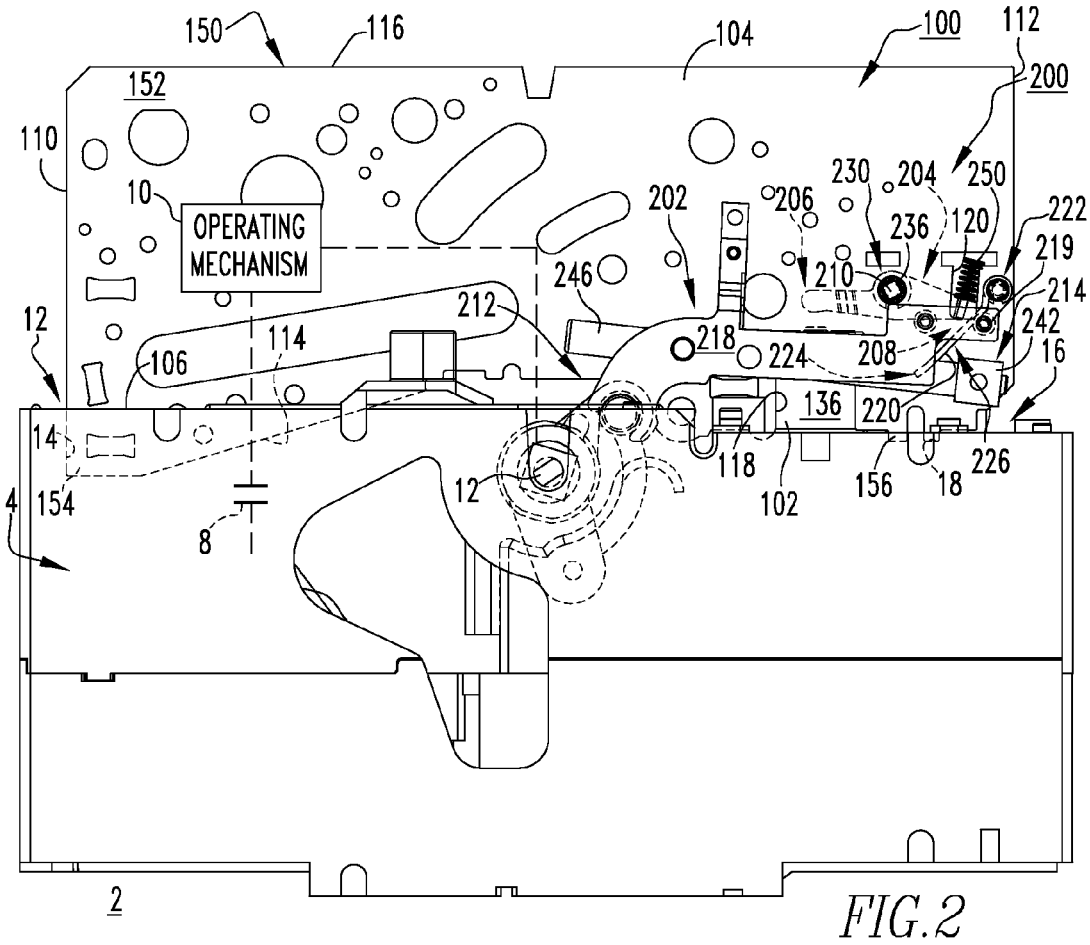
FIG. 2 is a side elevation view of the circuit breaker and trip actuator assembly therefor of FIG. 1, showing portions of the circuit breaker in block form.

FIG. 1 shows an electrical switching apparatus such as, for example, a low-voltage circuit breaker 2, and a trip actuator assembly 100 and a trip actuator reset assembly 200 therefor. The circuit breaker 2 includes a housing 4 having a mounting surface 6, separable contacts 8 (shown in simplified form in FIG. 2) enclosed by the housing 4, and an operating mechanism 10 (shown in simplified form in FIG. 2), which is structured to open and close the separable contacts 8 (FIG. 2).

The trip actuator assembly 100 includes a trip actuator 102 (e.g., without limitation, a solenoid 102), which is structured to be cooperable with the circuit breaker operating mechanism 10 (FIG. 2), and a planar member 104. The planar member 104 has first and second ends 110,112, first and second edges 114,116, and at least one aperture 118,120. The planar member 104 of the example circuit breaker 2 shown and described herein, is a first side plate 104 having first and second apertures 118,120. The example circuit breaker 2 also includes a second side plate 106. The trip actuator 102 is structured to be at least partially disposed within the first aperture 118 between the first side plate 104 and the mounting surface 6 of the housing 4. More specifically, the trip actuator 102 includes an enclosure 130 having a first end 132 with an actuating element 138 (e.g., without limitation, a plunger), and a second end 134 disposed opposite and distal from the first end 132. When the trip actuator 102 is removably coupled to the mounting surface 6 of the circuit breaker housing 4, as shown in FIG. 1 (see also FIG. 3), the first end 132 of the trip actuator enclosure 130 is engaged by the first side plate 104 at the aperture 118 thereof, and the second end 134 of the trip actuator enclosure 130 is disposed adjacent the mounting surface 6 of the circuit breaker housing 4.

Figure 3:
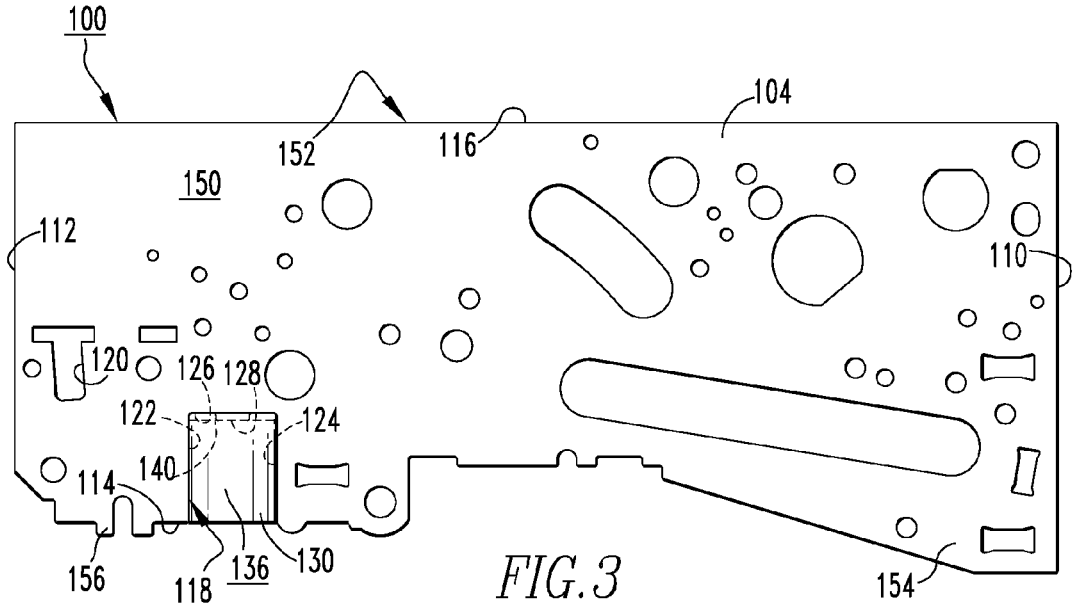
FIG. 3 is a side elevation view of the side plate and trip actuator of FIG. 2.
Figure 4:
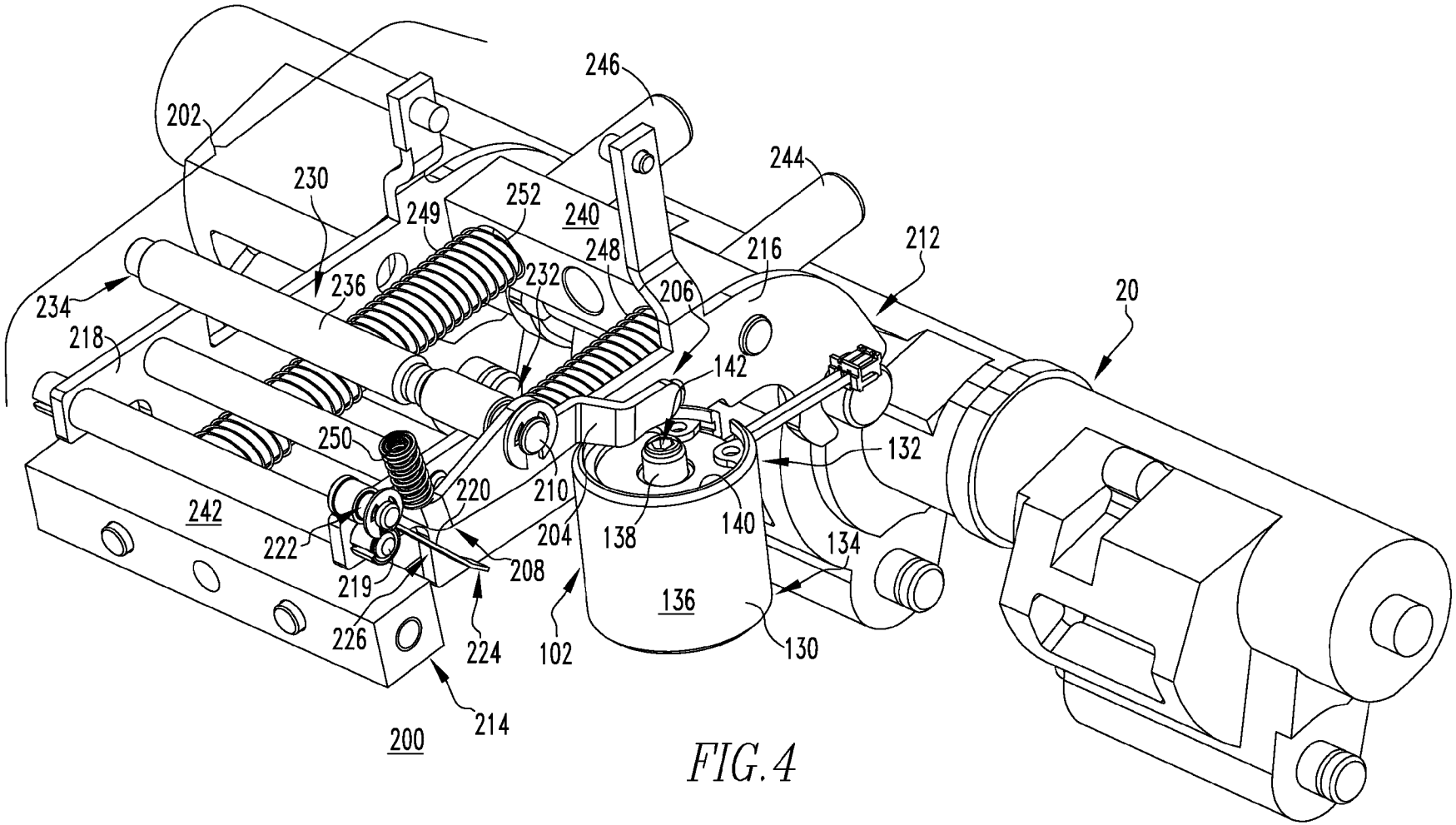
FIG. 4 is an isometric view of the trip actuator assembly of FIG. 1, also showing the pole shaft and cradle assembly of the circuit breaker operating mechanism.

The first end 132 of the trip actuator enclosure 130 further includes a recess 140, as shown in FIGS. 1, 3 (shown in hidden line drawing), 4 and 6. As shown in FIG. 3, the first aperture 118 of the example first side plate 104 is a cut-out having a first edge 122, a second edge 124, and a top 126. The top 126 of the first aperture 118 includes a protrusion 128 which extends into the recess 140 of the first end 132 of the trip actuator enclosure 130, in order to secure the trip actuator 102 within the first aperture 118. The first side plate 104 further includes a first side 150 and a second side 152, and the enclosure 130 of the trip actuator 102 further includes a body, which in the example shown and described herein is a cylinder 136. The cylinder 136 extends between the first and second ends 132,134 of the trip actuator enclosure 130, and extends through the first aperture 118 of the first side plate 104 in order to be disposed on both the first and second sides 150,152 of the first side plate 104. More specifically, the cylinder 136 has a center 142. The plunger 138 of the trip actuator 102 is disposed in the center 142 of the cylinder 136, as shown in FIGS. 1 and 4. The first portion of the cylinder 136, which is disposed on the first side 150 of the first side plate 104, is greater than the second portion of the cylinder 136, which is disposed on the second side 152 of the first side plate 104, in order that the plunger 138 is disposed on the first side 150 of the first side plate 104, as shown in FIG. 1.

In view of the foregoing, it will be appreciated that disclosed trip actuator assembly 100 effectively maintains the trip actuator 102 in a desired position within the circuit breaker 2. Specifically, it will be appreciated that the trip actuator 102 is secured directly by the first side plate 104 to the mounting surface 6 of the circuit breaker housing 4. Additionally, the first side plate 104 is preferably substantially flat and devoid of deformations (e.g., without limitation, bends). It will, therefore, be appreciated that the trip actuator 102 is secured directly by the first side plate 104, without requiring any intermediate component (e.g., without limitation, a mounting bracket), or, for example, a mounting flange. Thus, it is the first side plate 104 that, by itself, functions as the mounting element for precisely mounting the trip actuator 102 within the circuit breaker 2. This, along with the fact that circuit breaker components which interact with the trip actuator 102 (e.g., without limitation, the cradle assembly 202 and the reset lever 204 of the trip actuator reset assembly 200 discussed hereinbelow with respect to FIGS. 4, 5A, 5B), are directly coupled to the first side plate 104, results in precise, consistent operation of the trip actuator 102. In this manner, the disclosed trip actuator assembly 100 overcomes the aforementioned disadvantages (e.g., without limitation, misalignment) associated with known trip actuator assembly designs.

As an added benefit, the example trip actuator assembly 100 also reduces the number of components and/or fasteners required to accurately position the trip actuator 102 within the circuit breaker 2, and thereby further simplifies the installation, removal and/or maintenance of the trip actuator 102. Specifically, as will now be discussed, the first side plate 104 removably couples the trip actuator 102 to the circuit breaker housing 4, without a plurality of separate fasteners. In particular, as shown in FIGS. 1 and 2, the mounting surface 6 of the circuit breaker housing 4 includes a first end 12 having a first slot 14 (shown in hidden line drawing in FIG. 2), and a second end 16 disposed opposite and distal from the first end 12, and including a second slot 18 (shown in hidden line drawing in FIG. 2). Continuing to refer to FIGS. 1 and 2, and also to FIG. 3, it will be appreciated that the first edge 114 of the example first side plate 104 includes a first extension 154 (shown in hidden line drawing in FIG. 2) at or about the first end 110 of the first side plate 104, and a second extension 156 disposed at or about the second end 112 of the first side plate 104. The first extension 154 is structured to removably engage the first slot 14, of the circuit breaker housing 4, and the second extension 156 is structured to removably engage the second slot 18 of the circuit breaker housing 4. Accordingly, it will be appreciated that the first extension 154 of the example first side plate 104 is pivotable with respect to the first slot 14, in order that the second extension 156 can engage and disengage the second slot 18 to relatively easily secure and release, respectively, the trip actuator 102, as desired. It will, however, be appreciated that the first side plate 104 and, in particular, the first edge 114 of such side plate 104, could have any known or suitable alternative number and/or configuration of extensions (e.g., 154,156) or other suitable securing mechanism (not shown) structured to suitably engage the circuit breaker housing 4, without departing from the scope of the invention.

As will be described in greater detail hereinbelow, the example circuit breaker 2 further includes at least one linking member such as, for example and without limitation, the cradle assembly 202 of FIGS. 1, 2, 4, 5A, 5B and 5C (see also cradle assembly 302 of FIGS. 6, 7A, 7B and 7C) and the reset lever 204 of FIGS. 1, 2, 4, 5A, 5B and 5C (see also reset lever 304 of FIGS. 6, 7A, 7B and 7C). These components are coupled to the operating mechanism 10 (FIG. 2) and, in particular, the pole shaft 20 (shown in hidden line drawing in FIG. 2; see also FIGS. 4, 5A, 5B, 5C, 6, 7A, 7B and 7C) of the circuit breaker 2, and as previously discussed, are also coupled to the first side plate 104 of the example trip actuator assembly 100. As will be described in greater detail with respect to FIGS. 4, 5A, 5B and 5C, the reset lever 204 includes a first end 206, a second end 208, and a pivot 210 structured to pivotally couple the reset lever 204 to the first side 150 of the first side plate 104, as shown in FIG. 1. The cradle assembly 202 is disposed on the second side 152 of the first side plate 104, as shown in FIGS. 1 and 5C. The first end 206 of the reset lever 204 is cooperable with the plunger 138 of the trip actuator 102 on the first side 150 of the first side plate 104. The second end 208 of the example reset lever 204 extends through the second aperture 120 of the first side plate 104 and cooperates with a portion of the cradle assembly 202 on the second side 152 of the first side plate 104, as will be discussed.

In order to further secure the trip actuator 102 in the desired position with respect to the circuit breaker 2 and, in particular, the operating mechanism 10 (FIG. 2), the mounting surface 6 of the housing 4 of the example circuit breaker 2 further includes a number of outwardly extending protrusions 30,32 (FIG. 1). When the trip actuator 102 is removably coupled to the mounting surface 6, the body 136 of the trip actuator enclosure 130, at or about the second end 134 thereof, is secured by at least one of the outwardly extending protrusions 30,32. Two molded protrusions 30,32, which extend outwardly from the mounting surface 6, are shown securing the second end 134 of the trip actuator enclosure 130 in the example of FIG. 1. It will, however, be appreciated that any known or suitable alternative number and/or configuration of protrusions or other suitable securing mechanism (not shown) could be employed, without departing from the scope of the invention. It will also be appreciated that the trip actuator 102 may, for example, "snap" into position between a suitable number of protrusions (e.g., 30,32) to be secured. The example protrusion 32 further includes a hole 34, and receives a fastener, such as the screw 36 shown in exploded orientation in FIG. 1. The screw 36 is fastenable within the hole 34 to further secure the trip actuator 102.

The housing 4 of the example circuit breaker 2 also includes an accessory tray 40 which, for economy of disclosure, is shown in simplified form in phantom line drawing in FIG. 1. The accessory tray 40 is insertable on the mounting surface 6 of the housing 4, as shown, and is also removable. When the accessory tray 40 is inserted (shown), it abuts the body 136 of the trip actuator enclosure 130, in order to further secure the trip actuator 102 in the desired position. More specifically, the accessory tray 40 includes first and second edges 42,44. The first edge 42 has an arcuate recess 46 corresponding to the cylindrical body 136 of the trip actuator enclosure 130. Accordingly, when the accessory tray 40 is inserted, as shown in FIG. 1, the arcuate recess 46 of the accessory tray 40 engages and secures a portion of the cylindrical body 136.

In view of the foregoing, it will be appreciated that the disclosed trip actuator assembly 100 functions to removably secure the trip actuator 102 in a precise orientation within the circuit breaker 2 (FIGS. 1 and 2). In addition to the aforementioned advantages (e.g., without limitation, precise alignment; consistent operation of the trip actuator), precise mounting of the trip actuator 102 also helps to ensure that the trip actuator 102 is effectively and consistently reset following a trip of the circuit breaker 2 in response to a trip condition, as will now be discussed.

FIGS. 4, 5A, 5B and 5C, show the trip actuator reset assembly 200 for the circuit breaker 2. Specifically, the trip actuator reset assembly 200 includes the aforementioned cradle assembly 202, reset lever 204, and trip actuator 102, as well as a resilient element 220, and a guide member 230. The cradle assembly includes a first end 212, which is pivotally coupled to the pole shaft 20 of the circuit breaker 2 (FIGS. 1 and 2), and a second end 214 disposed opposite and distal from the first end 212. The cradle assembly 202 is movable among a first position (FIGS. 4 and 5A; see also first position of cradle assembly 302 of FIG. 7A) corresponding to the separable contacts 8 (FIG. 2) of the circuit breaker 2 (FIGS. 1 and 2) being closed, and a second position (FIGS. 5B and 5C; see also second position of cradle assembly 302 of FIGS. 7B and 7C) corresponding to the separable contacts 8 (FIG. 2) being open. In response to the trip condition, the plunger 138 of the trip actuator 102 is structured to move (upward with respect to FIG. 5A) the first end 206 of the reset lever 204. Subsequently, the trip actuator 102 must be reset.

The resilient element 220 is pivotally coupled to the circuit breaker housing 4 (FIG. 1). In the example shown and described herein, the resilient element 220 is a leaf spring having a first end 222 pivotally coupled to the second side 152 of the first side plate 104 proximate the second end 208 of the reset lever 204. The second end 224 of the leaf spring 220 is disposed opposite and distal from the first end 222, and an intermediate portion 226 of the leaf spring 220 is disposed between the first and second ends 222,224. When the cradle assembly 202 moves (e.g., pivots clockwise with respect to FIG. 5A) from the first position (FIGS. 4 and 5A) toward the second position (FIGS. 5B and 5C), the guide member 230 guides the cradle assembly 202 into engagement with the resilient element 220, which pivots the reset lever 204. More specifically, the cradle assembly 202 is pulled by the pole shaft 20 and, in response, has a tendency to pivot. However, when the cradle assembly 202 begins to pivot, the top edges of the first and second sides 216,218 (both shown in FIGS. 1 and 4) engage the guide member 230, which prevents it from continuing to pivot, instead forcing it to slide into engagement with the resilient element 220, as shown in FIG. 4. In particular, a protrusion 219, which extends outwardly from the first side 216 of the cradle assembly 202 engages and moves the resilient element 220. The resilient element 220 then pivots the reset lever 204 such that the first end 206 of the reset lever 204 depresses the plunger 138 of the trip actuator 102, thereby resetting the trip actuator 102. After the trip actuator 102 has been reset, if the cradle assembly 202 has a tendency to continue to move beyond the second position (FIGS. 5B and 5C), the intermediate portion 226 of the resilient element 220 bends, as shown in exaggerated form in FIGS. 5B and 5C. In this manner, the resilient element 220 (e.g., without limitation, leaf spring) accommodates any additional energy and associated motion (e.g., over-rotation) that the cradle assembly 202 may have. Accordingly, the disclosed trip actuator reset assembly 200 overcomes the aforementioned disadvantages (e.g., without limitation, over-rotation; damage to the plunger 138) associated with known trip actuator reset assemblies.

More specifically, as shown in FIGS. 1 and 4, the guide member 230 includes first and second ends 232,234, and in an elongated body 236 extending therebetween. The elongated body 236 extends between the first and second side plates 104,106 of the circuit breaker 2, as shown in FIG. 1. The example reset lever 204 further includes a bias element such as, for example and without limitation, the spring 250, which is shown. The bias element 250 is structured to bias the second end 208 of the reset lever 204, in order to bias and thus pivot (e.g., counterclockwise from the perspective of FIGS. 4, 5A and 5B; clockwise from the perspective of FIG. 5C) the first end 206 of the reset lever 204, toward the position shown in FIGS. 4 and 5A. As partially shown in simplified form in phantom line drawing in FIG. 5C, the example bias element 250 is disposed within the second aperture or hole 120 of the first side plate 104 (see also FIGS. 1 and 2). In this manner, the first end 206 of the reset lever 204 is biased away from the plunger 138 of the trip actuator 102.

The aforementioned first side 216 (FIGS. 4, 5A and 5B) of the cradle assembly 202 extends from the pole shaft 20 toward the second end 214 of the cradle assembly 202. The example cradle assembly 202 also includes a second side 218 (FIG. 5C), which is disposed opposite and spaced apart from the first side 216. A first cross member 240, which is disposed proximate the first end 212 of the cradle assembly 202, extends between the first and second sides 216,218, and is structured not to move independently with respect to the first and second sides 216,218. A second cross member 242 is disposed at or about the second end 214 of the cradle assembly 202, and is structured to extend between, and be pivotally coupled to, the first and second side plates 104,106 of the circuit breaker 2 (FIGS. 1 and 2). Thus, the second cross member 242 provides a fixed pivot point for the cradle assembly 202 with respect to the first and second side plates 104, 106, and the trip actuator 102. At least one elongated member such as, for example and without limitation, the first and second rods 244,246 shown in FIG. 4, is/are fixedly coupled to the second cross member 242, and extend through the first cross member 240. Specifically, as will be appreciated with reference to second rod 246 of FIG. 4, each of the example elongated members 244,246 extend through a corresponding thru hole (only one thru hole 252 is shown in FIG. 4; see also rods 344,346 extending through thru holes 351,352 in FIG. 6) in the first cross member 240 of the cradle assembly 202. It will, therefore, be appreciated that a portion (e.g., without limitation, first and second sides 216,218; pivot 219; first cross member 240) of the cradle assembly 202 can move on the elongated members 244,246 with respect to a second portion (e.g., without limitation, second cross member 242) of the cradle assembly 202, in order to accommodate movement of the pole shaft 20 and/or cradle assembly 202, for example, during a reset operation of the trip actuator 102.

In the example of FIG. 4, the first and second rods 244,246 further include first and second springs 248,249, respectively. The springs 248,249 are disposed between the first and second cross members 240,242 of the cradle assembly 202, and the rods 244,246 pass through the coils of the springs 248, 249, respectively. The springs 248,249 have a tendency to bias the cradle assembly 202 toward the second position (FIGS. 5B and 5C; see also cradle assembly 302 shown in the second position in FIGS. 7B and 7C). It will, however, be appreciated that such springs (e.g., 248,249) shown and described with respect to FIG. 4 are not intended to be a limiting element of the disclosed trip actuator reset assembly 200. For example, the cradle assembly 202 could be devoid of such springs, without departing from the scope of the invention.

Figure 5A:
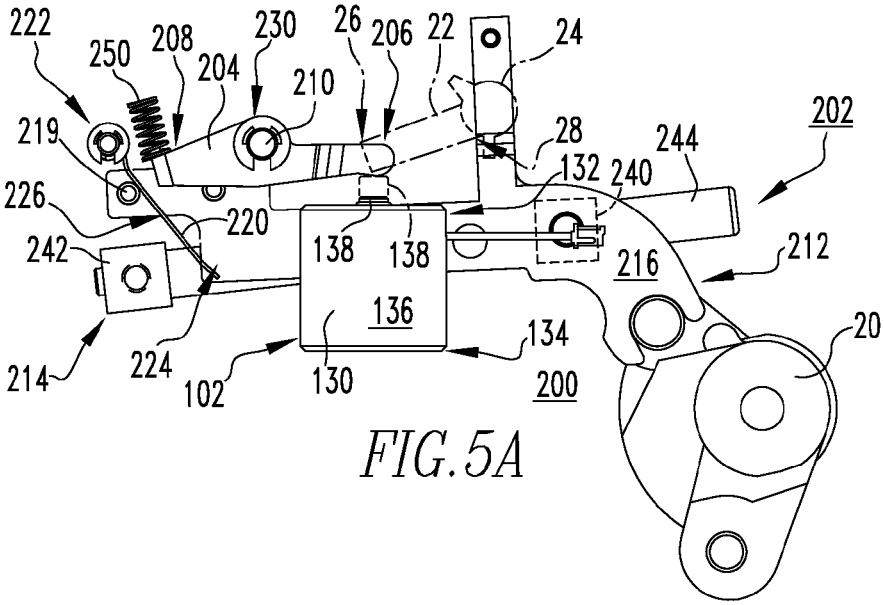
FIG. 5A is a right side elevation view of the trip actuator assembly, and pole shaft and cradle assembly of FIG. 4, with each component shown in its respective position corresponding to the circuit breaker being closed.
Figure 5B:
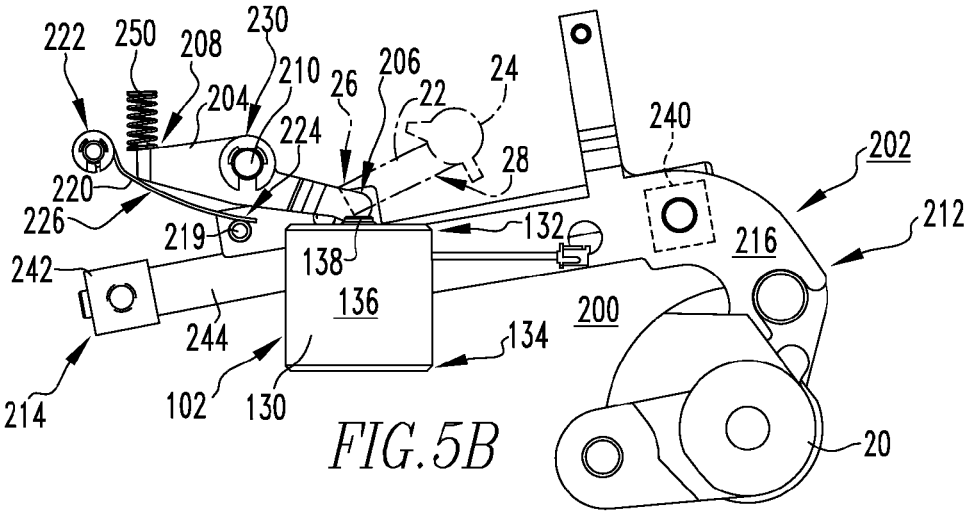
FIGS. 5B and 5C are right and left side elevation views, respectively, of the trip actuator assembly, and pole shaft and cradle assembly of FIG. 5A, modified to show each component in its respective position corresponding to the circuit breaker being open.
Figure 5C:
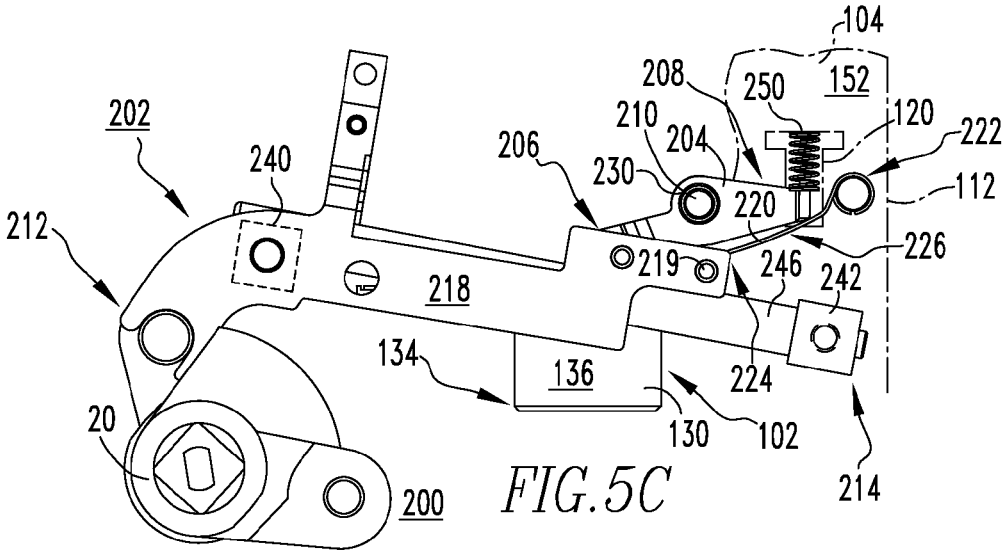
Figure 7A:
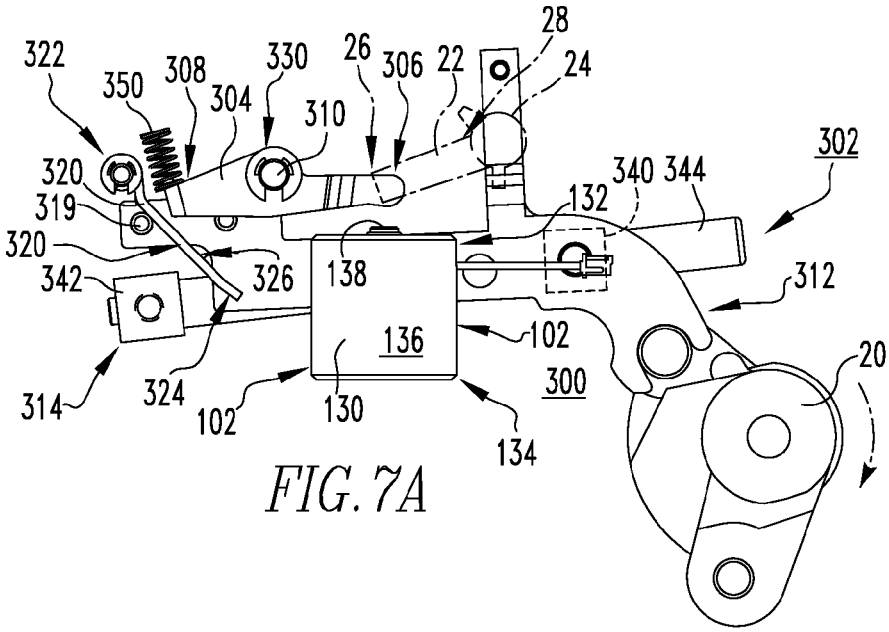
FIG. 7A is a right side elevation view of the trip actuator assembly, and pole shaft and cradle assembly of FIG. 6, with each component shown in its respective position corresponding to the circuit breaker being closed.
Figure 7B:
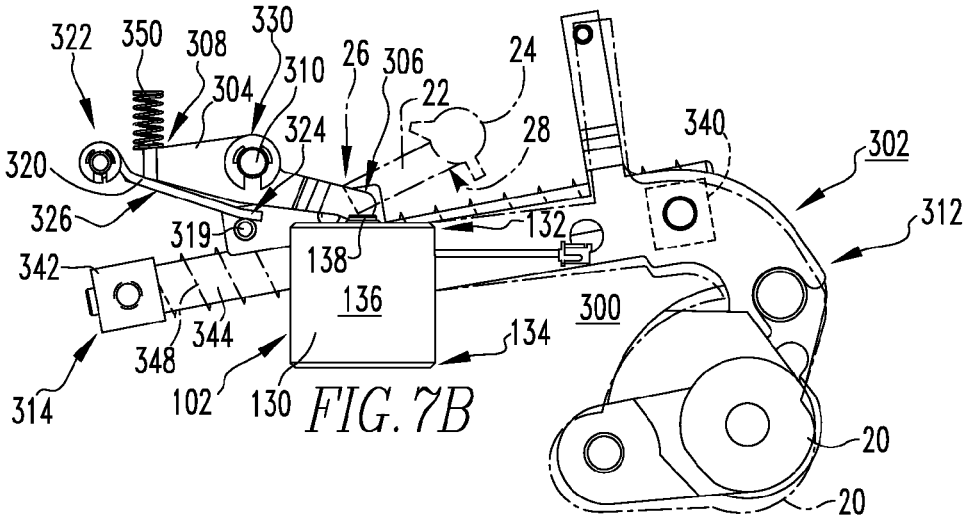
FIGS. 7B and 7C are right and left side elevation views, respectively, of the trip actuator assembly, and pole shaft and cradle assembly of FIG. 7A, modified to show each component in its respective position corresponding to the circuit breaker being open.
Figure 7C:
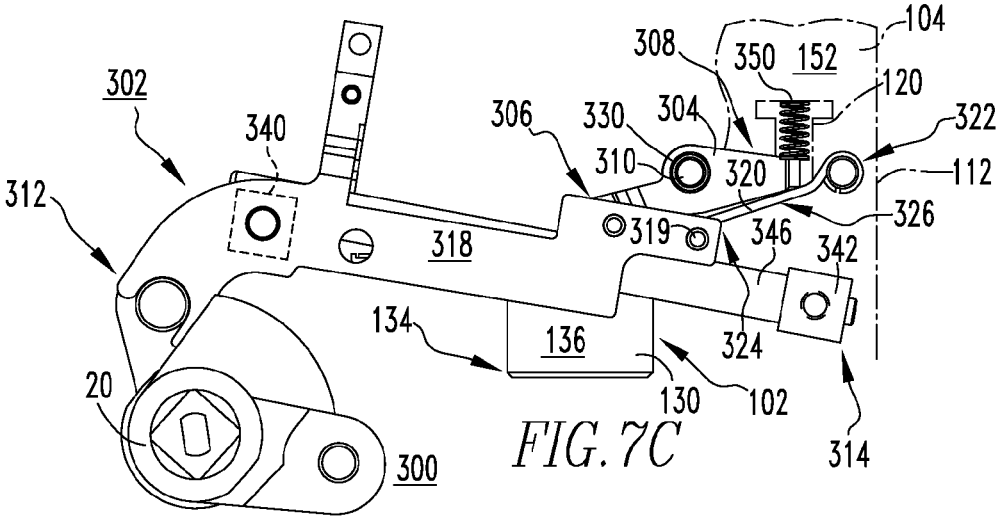

The operating mechanism 10 (shown in simplified form in FIG. 2) of the example circuit breaker 2 (FIGS. 1 and 2) further includes a trip bar 24 and trip lever 22, both of which are shown in simplified form in phantom line drawing in FIGS. 1, 5A and 5B (see also FIGS. 7A and 7B). The trip lever 22 includes a first end 26, which overlays the plunger 138 of the trip actuator 102, and a second end 28, which is coupled to the trip bar 24. The first end 26 of the example trip lever 22 is also cooperable with the first end 206 of the reset lever 204 of the trip actuator reset assembly 200, in order that the trip lever 22 and reset lever 204 are movable together in certain modes of operation (e.g., when the plunger 138 of the trip actuator 102 pushes them, as shown in phantom line drawing in FIG. 5A). More specifically, as partially shown in phantom line drawing in FIG. 1, the example trip lever 22 is structured to overlay (e.g., without limitation, straddle) the first end 206 of the reset lever 204.

An operation of the trip actuator reset assembly 200 to reset the trip actuator 102 following a trip condition, will now be discussed with reference to FIGS. 5A, 5B and 5C. It will be appreciated that except for the distinctions discussed herein, the trip actuator reset assembly 300 discussed hereinbelow with respect to FIGS. 6, 7A, 7B and 7C functions in substantially the same manner. Specifically, as previously discussed, the example trip actuator is a solenoid 102 having as its actuating element, a plunger 138. In response to the trip condition, the plunger 138 extends in order to pivot the reset lever 204 and the trip lever 22, as shown in phantom line drawing in FIG. 5A. After the trip condition, the plunger 138 remains extended until it is depressed by the reset lever 204 in order to reset the trip actuator 102 and the trip lever 22. Specifically, to begin a reset operation, during which the pole shaft 20 and cradle assembly 202 move from the position shown in FIG. 5A toward the position shown in FIGS. 5B and 5C, the protrusion 219 of the cradle assembly 202 engages the resilient element 220 (e.g., without limitation, leaf spring) and pivots it about its first end 222, as previously discussed. The intermediate portion 226 of the resilient element 220 then engages the second end 208 of the reset lever 204, thereby pivoting the reset lever 204 until the first end 206 of the reset lever 204 engages and depresses the plunger 138, as shown in FIG. 5B. When the plunger 138 is fully depressed, the trip actuator 102 is reset. Simultaneously, the trip lever 22, which in the example shown and described herein is cooperable with (e.g., overlays) the reset lever 204, is also reset.

Unique to the disclosed trip actuator reset assembly 200 is that, after the trip actuator 102 is reset, if the cradle assembly 202 has a tendency to continue to move, for example, thereby having a tendency to over-rotate the reset lever 204 and potentially damage the plunger 138 and/or trip actuator 102 or a component (e.g., without limitation, cradle assembly 202) of the trip actuator reset assembly 200, the intermediate portion 226 of the resilient element 220 advantageously bends to absorb such movement, as previously discussed. The disclosed trip indicator reset assembly 200, therefore, resists undesirable consequences, for example, associated with over-rotation of the cradle assembly 202.

It will, however, be appreciated that the trip actuator reset assembly (e.g., 200) and components (e.g., without limitation cradle assembly 202; reset lever 204; resilient element 220)

could comprise any known or suitable alternative configuration. For example, FIGS. 6, 7A, 7B and 7C show a trip actuator reset assembly 300 which is substantially similar to the trip actuator reset assembly 200 discussed with respect to FIGS. 4, 5A, 5B and 5C, but includes a rigid element 320 as opposed to the resilient element 220 of trip actuator reset assembly 200. It will be appreciated that like features of the trip actuator reset assembly 300 are numbered substantially the same as those previously discussed with respect to trip actuator reset assembly 200, but using 300 series reference numbers instead of 200 series reference numbers. For example, the cradle assembly 302, includes first and second ends 312,314, first and second sides 316,318, first and second cross members 340,342, and first and second rods 344,346, all of which are substantially similar to the same features previously discussed in connection with trip actuator reset assembly 200 of FIGS. 4, 5A, 5B and 5C. For economy of disclosure, certain aspects of the trip actuator reset assembly 300 which are substantially the same as trip actuator reset assembly 200, discussed hereinabove, will not be repetitively discussed.

Figure 6:
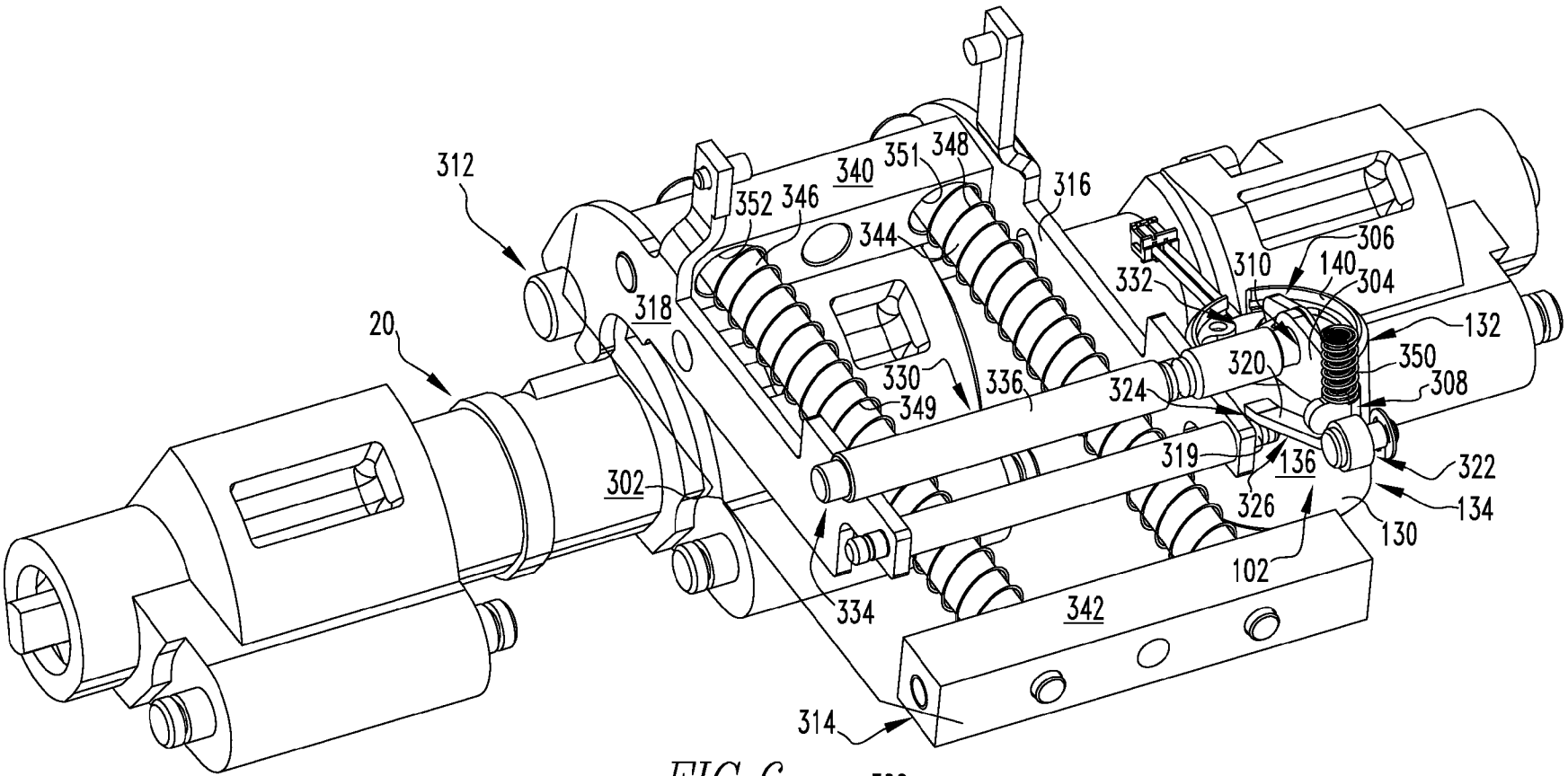
FIG. 6 is an isometric view of a trip actuator assembly in accordance with another embodiment of the invention, also showing the pole shaft and cradle assembly of the circuit breaker operating mechanism.

In addition to the distinction of the rigid element 320 which, unlike the aforementioned resilient element 220 (e.g., without limitation, leaf spring) is not intended to bend or otherwise deflect, the trip actuator reset assembly 300 is further different from trip actuator reset assembly 200 in that the springs 348,349 or suitable equivalent resilient element(s) is/are required elements of the cradle assembly 302. This is because any additional movement (e.g., without limitation, over-rotation) of, for example, the cradle assembly 302, that is experienced during the reset operation, must be accommodated by the springs 348,349. In other words, after the trip actuator 102 has been reset, if the cradle assembly 302 continues to move beyond the second position, as shown in phantom line drawing in FIG. 7B, then the springs 348,349 (both are shown in FIG. 6) of the cradle assembly 302 flex (e.g., extend) to accommodate the additional motion, and thereby resist damage to components of the trip actuator reset assembly 300 such as, for example and without limitation, the plunger 138, the trip actuator 102, the reset lever 304 and/or the cradle assembly 302. Thus, as will be appreciated by comparing FIG. 7B to FIG. 5B, previously discussed in connection with trip actuator reset assembly 200, rather than bending or otherwise deflecting the resilient element 220, as shown in exaggerated form in FIG. 5B, in order to absorb additional motion of the cradle assembly 202, the intermediate portion 326 of the rigid element 320 of the example of FIG. 7B does not bend or otherwise deflect. Instead, the cradle assembly 302 itself and, in particular, the springs 348, 349 thereof, absorb the additional movement. It will be appreciated that the remainder of the operation of trip actuator reset assembly 300 to reset the trip actuator 102 and trip lever 22 is substantially the same as for trip actuator reset assembly 200, previously discussed. It will also be appreciated that, rather than, or in addition to, the springs 348,349, the opening spring (not shown) of the circuit breaker (FIGS. 1 and 2) could be employed to accommodate the excess movement of the cradle assembly 302, for example, by allowing the cradle assembly 302 to flex.

It will, therefore, be appreciated that the disclosed trip actuator reset assemblies 200,300 can accommodate, for example and without limitation, misalignment and/or over-rotation associated therewith, in order to effectively, consistently reset the trip actuator 102 of the circuit breaker (FIGS. 1 and 2). It will also be appreciated that the components of the trip actuator reset assemblies 200,300 could be shaped and configured in a wide variety of alternative arrangements (not shown) in order to achieve this goal in accordance with the invention. For example, although the rigid element 320 shown and described in the example of FIGS. 6, 7A, 7B and 7C is an elongated member having a first end 322 pivotally coupled to the second side 152 of the first side plate 104 (shown in phantom line drawing in FIG. 7C), a second end 324 disposed opposite and distal from the first end 322, and the intermediate portion 326 therebetween, it could alternatively have any suitable shape and/or configuration (not shown). For instance, a protrusion (not shown) of the cradle assembly (e.g., 302) itself could pivot the reset lever 304, thus eliminating the need for a separate rigid element (e.g., 320).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A trip actuator assembly for an electrical switching apparatus including a housing having a mounting surface, separable contacts enclosed by said housing, and an operating mechanism structured to open and close said separable contacts, said trip actuator assembly comprising:

a trip actuator structured to be cooperable with said operating mechanism; and a planar member comprising a first end, a second end disposed opposite and distal from the first end, a first edge, a second edge disposed opposite and distal from the first edge, and an aperture, wherein said trip actuator is structured to be at least partially disposed within said aperture and further to be disposed between said planar member and said mounting surface of said housing, and wherein the first edge of said planar member is structured to be removably coupled to said mounting surface of said housing, thereby being structured to removably couple said trip actuator to said housing wherein said trip actuator assembly further comprises at least one linking member pivotably coupled to said operating mechanism of said circuit breaker; and wherein said trip actuator and said at least one linking member are both coupled to said planar member of said trip actuator assembly, and wherein said planar member of said trip actuator assembly is a side plate having a first side, a second side, a first aperture, and a second aperture; wherein said at least one linking member is a cradle assembly and a reset lever; wherein said reset lever includes a first end and a second end disposed opposite and distal from the first end; wherein said trip actuator is disposed within said first aperture of said side plate and extends outwardly from the first side of said side plate and the second side of said side plate; wherein said cradle assembly is disposed on the second side of said side plate; wherein said reset lever is pivotably coupled to the first side of said side plate; wherein the first end of said reset lever is cooperable with said trip actuator on the first side of said side plate; and wherein the second end of said reset lever extends through said second aperture of said side plate and cooperates with a portion of said cradle assembly on the second side of said side plate.

2. The trip actuator assembly of claim 1 wherein said trip actuator comprises an enclosure including a first end having an actuating element, and a second end disposed opposite and distal from the first end of said enclosure of said trip actuator; and wherein, when said trip actuator is removably coupled to said mounting surface of said housing, the first end of said enclosure of said trip actuator is engaged by said planar member at said aperture and the second end of said enclosure of said trip actuator is structured to be disposed adjacent said mounting surface of said housing.

3. The trip actuator assembly of claim 2 wherein the first end of said enclosure of said trip actuator further has a recess; wherein said aperture comprises a first edge, a second edge, and a top; wherein the top of said aperture includes a protrusion; and wherein said protrusion is structured to extend into said recess of the first end of said enclosure of said trip actuator in order to secure said trip actuator within said aperture, and further to maintain said trip actuator in a desired position with respect to said housing.

4. The trip actuator assembly of claim 2 wherein said trip actuator is a solenoid; and wherein said actuating element of said solenoid is a plunger.

5. The trip actuator assembly of claim 2 wherein said planar member further comprises a first side and a second side; wherein said enclosure of said trip actuator further includes a body extending between the first end of said enclosure of said trip actuator and the second end of said enclosure of said trip actuator; and wherein said body extends through said aperture in order that a first portion of said body is disposed on the first side of said planar member and a second portion of said body is disposed on the second side of said planar member.

6. The trip actuator assembly of claim 5 wherein said electrical switching apparatus includes at least one side plate; wherein said planar member is a corresponding one of said at least one side plate; wherein said body is a cylinder having a center; wherein said actuating element is disposed in the center of said cylinder; and wherein said first portion of said cylinder, which is disposed on the first side of said corresponding one of said at least one side plate, is greater than the second portion of said cylinder, which is disposed on the second side of said corresponding one of said at least one side plate, in order that said actuating element is disposed on the first side of said corresponding one of said at least one side plate.

7. The trip actuator assembly of claim 1 wherein said mounting surface of said housing of said electrical switching apparatus comprises a first end including a first slot, and a second end disposed opposite and distal from the first end of said mounting surface of said housing, said second end of said mounting surface including a second slot; wherein the first edge of said planar member at or about the first end of said planar member is structured to removably engage said first slot; and wherein said planar member is structured to be pivoted until the first edge of said planar member at or about the second end of said planar member removably engages said second slot.

8. The trip actuator assembly of claim 1 wherein said planar member is structured to removably couple said trip actuator to said housing, without a plurality of separate fasteners.

9. An electrical switching apparatus comprising:

a housing including a mounting surface;

separable contacts enclosed by said housing;

an operating mechanism structured to open and close said separable contacts; and a trip actuator assembly comprising:

a trip actuator cooperable with said operating mechanism, and a planar member comprising a first end, a second end disposed opposite and distal from the first end, a first edge, a second edge disposed opposite and distal from the first edge, and an aperture, wherein said trip actuator is at least partially disposed within said aperture and further is disposed between said planar member and said mounting surface of said housing, wherein the first edge of said planar member is removably coupled to said mounting surface of said housing, thereby removably coupling said trip actuator to said housing, wherein said trip actuator assembly further comprises at least one linking member pivotably coupled to said operating mechanism of said circuit breaker; and wherein said trip actuator and said at least one linking member are both coupled to said planar member of said trip actuator assembly, and wherein said electrical switching apparatus is a circuit breaker; wherein said planar member of said trip actuator assembly is a side plate having a first side, a second side, a first aperture, and a second aperture; wherein said at least one linking member is a cradle assembly and a reset lever; wherein said reset lever includes a first end and a second end disposed opposite and distal from the first end; wherein said trip actuator is disposed within said first aperture of said side plate and extends outwardly from the first side of said side plate and the second side of said side plate; wherein said cradle assembly is disposed on the second side of said side plate; wherein said reset lever is pivotably coupled to the first side of said side plate; wherein the first end of said reset lever is cooperable with said trip actuator on the first side of said side plate; and wherein the second end of said reset lever extends through said second aperture of said side plate and cooperates with a portion of said cradle assembly on the second side of said side plate.

10. The electrical switching apparatus of claim 9 wherein said trip actuator comprises an enclosure including a first end having an actuating element, and a second end disposed opposite and distal from the first end of said enclosure of said trip actuator; and wherein, when said trip actuator is removably coupled to said mounting surface of said housing, the first end of said enclosure of said trip actuator is engaged by said planar member at said aperture and the second end of said enclosure of said trip actuator is disposed adjacent said mounting surface of said housing.

11. The electrical switching apparatus of claim 10 wherein the first end of said enclosure of said trip actuator further has a recess; wherein said aperture comprises a first edge, a second edge, and a top; wherein the top of said aperture includes a protrusion; and wherein said protrusion extends into said recess of the first end of said enclosure of said trip actuator in order to secure said trip actuator within said aperture, thereby maintaining said trip actuator in a desired position with respect to said housing.

12. The electrical switching apparatus of claim 10 wherein said planar member of said trip actuator assembly further comprises a first side and a second side; wherein said enclosure of said trip actuator further includes a body extending between the first end of said enclosure of said trip actuator and the second end of said enclosure of said trip actuator; and wherein said body extends through said aperture in order that a first portion of said body is disposed on the first side of said planar member and a second portion of said body is disposed on the second side of said planar member.

13. The electrical switching apparatus of claim 12 wherein said planar member of said trip actuator assembly is a side plate; wherein said body is a cylinder having a center; wherein said actuating element is disposed in the center of said cylinder; and wherein said first portion of said cylinder, which is disposed on the first side of said side plate, is greater than the second portion of said cylinder, which is disposed on the second side of said side plate, in order that said actuating element is disposed on the first side of said side plate.

14. The electrical switching apparatus of claim 9 wherein said mounting surface of said housing of said electrical switching apparatus comprises a first end including a first slot, and a second end disposed opposite and distal from the first end of said mounting surface of said housing, said second end of said mounting surface including a second slot; wherein the first edge of said planar member of said trip actuator assembly at or about the first end of said planar member includes a first extension; wherein the first edge of said planar member at or about the second end of said planar member includes a second extension; wherein said first extension removably engages said first slot; and wherein said planar member is pivotable with respect to said first slot and said second extension removably engages said second slot.

15. The electrical switching apparatus of claim 9 wherein said trip actuator assembly further comprises at least one linking member pivotably coupled to said operating mechanism of said circuit breaker; and wherein said trip actuator and said at least one linking member are both coupled to said planar member of said trip actuator assembly.

16. The electrical switching apparatus of claim 9 wherein said trip actuator of said trip actuator assembly comprises an enclosure including a first end, a second end disposed opposite and distal from the first end of said enclosure, and a body extending between the first end of said enclosure and the second end of said enclosure; wherein said mounting surface of said housing of said circuit breaker comprises a number of outwardly extending protrusions; and wherein, when said trip actuator is removably coupled to said mounting surface of said housing, said body of said enclosure of said trip actuator at or about the second end of said enclosure of said trip actuator is secured by at least one of said outwardly extending protrusions, in order to secure said trip actuator in a predetermined position with respect to said operating mechanism of said circuit breaker.

17. The electrical switching apparatus of claim 16 wherein said housing of said circuit breaker further includes an accessory tray; wherein said accessory tray is insertable on said mounting surface of said housing and removable from said mounting surface of said housing; and wherein, when said accessory tray is inserted, said accessory tray abuts said body of said enclosure of said trip actuator in order to further secure said trip actuator in said predetermined position.

18. The electrical switching apparatus of claim 17 wherein said body of said enclosure of said trip actuator is a cylinder; wherein said accessory tray includes a first edge having an arcuate recess and a second edge disposed opposite and distal from the first edge of said accessory tray; and wherein, when said accessory tray is inserted, said arcuate recess of said accessory tray engages and secures a portion of said cylinder.

19. The electrical switching apparatus of claim 9 wherein said planar member of said trip actuator assembly removably couples said trip actuator to said housing, without a plurality of separate fasteners.

* * * * *